US005407735A

United States Patent [19]

Fukuda et al.

[11] Patent Number: 5,407,735

[45] Date of Patent: Apr. 18, 1995

[54] TAPERED FIBER AND NAPPED FABRIC UTILIZING THE SAME

[75] Inventors: Keiji Fukuda, Kyouwa; Eiji Akiba, Saijo; Takao Akagi, Kurashiki, all of Japan

[73] Assignee: Kuraray Co., Ltd., Kurashiki, Japan

[21] Appl. No.: 135,333

[22] Filed: Oct. 13, 1993

[30] Foreign Application Priority Data

Oct. 13, 1992 [JP] Japan ..... 4-274344

[51] Int. Cl.[6] ..... D03D 3/00

[52] U.S. Cl. ..... 428/224; 428/92; 428/93; 428/373; 428/370; 428/374; 428/401; 428/400; 428/85; 428/397

[58] Field of Search ..... 428/374, 370, 397, 92, 428/97, 93, 95, 85, 373, 224, 400, 401; 8/532

[56] References Cited

U.S. PATENT DOCUMENTS 4,461,791 7/1984 Matsui et al. ..... 428/92
4,525,404 6/1985 Matsui et al. ..... 428/92

FOREIGN PATENT DOCUMENTS 0134141 3/1985 European Pat. Off. .
0450300 10/1991 European Pat. Off. .
62-268855 11/1987 Japan .
1-306646 12/1989 Japan .
3-124858 5/1991 Japan .
4-214412 8/1992 Japan .

OTHER PUBLICATIONS

Patent Abstracts of Japan, vol. 14, No. 485 (C-772), Oct. 23, 1990, JP-A-2200814, Aug. 9, 1990.
Patent Abstracts of Japan, vol. 15, No. 17 (C-796), Jan. 14, 1991, JP-A-2264068, Oct. 26, 1990.
Patent Abstracts of Japan, vol. 16, No. 283 (C-955), Jun. 24, 1992, JP-A-4 073 242, Mar. 9, 1992.

*Primary Examiner*—N. Edwards
*Attorney, Agent, or Firm*—Oblon, Spivak, McClelland, Maier & Neustadt

[57] ABSTRACT

Provided is a sheath-core composite polyester fiber with both the core and the sheath comprising polyesters and at least one end thereof is tapered to its tip. Two groups of recesses having different diameter ranges are formed on the exposed core of the tapered part and on the surface of the sheath, respectively. Napped fabrics with raised fibers comprising the composite fibers have good hand with stiffness (KOSHI), excellent color developing property and color depth when dyed. The fabrics have no luster difference or color difference such as dark fading and white appearance and, besides, produce no whitened seams, so that they are suitable for car-seat covers and like uses.

3 Claims, 2 Drawing Sheets x5000 x5000

TAPERED FIBER AND NAPPED FABRIC UTILIZING THE SAME

BACKGROUND OF THE INVENTION

1. Field of the Invention

The present invention relates to a tapered fiber that can constitute napped fabrics having good hand with anti-drape stiffness, termed "HARI" in Japan, and stiffness, termed "KOSHI" in Japan, and excellent color developing property and depth of color and causing, after being sewn, no white appearance along seams. More specifically, the present invention relates to polyester fiber-based napped fabrics usable in a wide variety of uses such as interior fabrics, e.g. car seats and carpets, artificial suedes and clothing and to tapered fibers constituting the nap of such fabrics.

2. Description of the Prior Art

Napped fabrics such as standard cut-pile, moquette, double-raschel, velour and velvet have various appearances and hands and have been widely used as interior fabrics including car interior fabrics such as car seat covers, household interior fabrics such as carpets and flocked fabrics, artificial suedes and wearing apparel.

Fibers comprising polyester, in particular polyethylene terephthalate, are widely used for clothing, industrial purposes and interior fabrics.

In recent years in particular, polyethylene terephthalate fibers are penetrating rapidly into the field of car interior napped fabrics, utilizing its excellent light-fastness. However, napped fabrics comprising polyethylene terephthalate fiber have stiffer tactility and are significantly poorer in appearance such as luster and brightness, than those made of fibers of acrylic, nylon, rayon, silk, wool and the like. Besides, when these polyester fiber-based napped fabrics are dyed, they hardly give mild luster like that of napped fabrics comprising natural fibers such as wool and silk because of the surface of the fibers being smooth, and their hand lacks natural feeling, and it is difficult to give them deep color.

To make deep the color of dyed napped fabrics, it is generally recommended to use a super bright type of polyester fiber, containing no inorganic fine particles. However, although napped fabrics using this type of fiber for their nap have improved color development, they give a shining appearance depending on the angle seen and lack high-quality feeling. To eliminate this shining appearance, polyester fibers of semi-dull type containing a small amount of titanium oxide are being used for naps, which, however, deteriorates color developing property of the napped fabrics and make them look whitened when dyed in light colors. Such napped fabrics cannot produce high-quality feeling.

Furthermore, polyester fiber-based napped fabrics give, when dyed, different color shades depending on the angle seen, thereby creating variation in luster and depth of color. As a result they often show partly blackish and partly whitened as if covered with dust. Such napped fabrics further have a drawback that, when sewn, their raised fibers fall down along the seam and look whitish, i.e. what is known as "whitened seam", which impairs the high-quality feeling to a large extent. This is attributable to the fabrics having large surface reflection caused by large refractivity and smooth surface of the polyester fibers used and also to reduced color developing property due to large difference between the reflectivities of the side surface and cross-section of the polyester fibers.

Various proposals have been made to solve the above problems, i.e. to improve the color developing property of polyester fiber to be used for raised fibers of napped fabrics.

For examples, Japanese Patent Application Laid-open No. 268855/1987 discloses a sheath-core composite fiber comprising a core of polyester and a sheath of a cationically dyeable polyester. In this fiber, the sheath is dyed in a deeper color compared with the core, so that the side surface of the fibers become not so distinguishable even when exposed on the surface of the napped fabric containing them. However, the sheath, having been dyed with a cation dye to produce deep color, has poor lightfastness and hence napped fabrics utilizing such fibers are often unusable depending on the use.

Japanese Patent Application Laid-open No. 124858/1991 disclose a pile fabric comprising sheath-core composite polyester fibers with their core containing a larger amount of titanium oxide compared with their sheath so that the mirror reflection of the fiber side surface is reduced and does not differ so much from that of the fiber cross-section. Japanese Patent Application Laid-open No. 306646/1989 discloses a pile fabric comprising sheath-core composite fibers and having good color development and, at the same time, no shining appearance by adding an inorganic fine powder having high refractivity to the sheath only. However, incorporation of an inorganic fine powder having high refractivity such as titanium oxide to the core and/or sheath of a sheath-core composite fiber permits the surface reflectivity the fiber cross-section to become close to that of the fiber side surface, thereby being unable to solving the problems of white appearance, whitened seams and the like due to severe falling down of raised fibers, of the napped fabrics comprising such fibers as their naps.

It is known that roughening of the side surface of polyester fibers reduces the surface reflectivity because light incident on the roughened surface repeats zigzag reflections in the recesses and is eventually absorbed into the fibers. Japanese Patent Application Laid-open No. 214412/1992 discloses a napped fabric, utilizing the above technique, comprising raised fibers of sheath-core composite polyester fibers having roughened side surface to decrease the reflectivity of the fiber surface and being tapered to the ends to cause irregular reflection of light there, thereby increasing the surface reflectivity. With such polyester fibers, the difference between the surface reflectivities of the fiber cross-section and the fiber side surface becomes small and hence napped fabrics having a nap of such fibers no longer suffer from dark fading or white appearance. However, the problem of uneven color occurring with extreme falling down of raised fibers, such as whitened seams, cannot be solved completely with the napped fabrics with a nap comprising such fibers.

SUMMARY OF THE INVENTION

Aiming at high-quality napped fabrics with nap of wool, the present inventors have made an intensive study on napped fabrics with raised fibers comprising polyester fibers and found a napped fabric having excellent color developing property and mild luster with no uneven color or luster, such as dark fading and white appearance and whitened seams due to fiber falling down, and having good hand with stiffness (KGSHI).

The present invention provides a tapered fiber comprising a sheath-core composite polyester fiber with at least one end thereof tapered along its tip to expose its core outwardly, said exposed core having on the surface thereof 0.1 to 20 pieces/100 $\mu m^2$ of recesses having a diameter of 0.5 to 5 $\mu m$, the surface other than said exposed core part of said fiber having 20 to 1,000 pieces/100 $\mu m^2$ of recesses having a diameter of 0.2 to 0.7 $\mu m$.

The present invention further provides a napped fabric with raised fibers comprising sheath-core composite polyester fibers, the core of each of said fibers being exposed at the end and said fibers being tapered to the tips thereof in a length of at least 20% of their whole raised length.

The present invention still further provides a process for producing the above napped fabric, which comprises subjecting to alkali etching treatment a napped fabric with raised fibers comprising sheath-core composite polyester fibers, said sheath containing 0.5 to 5% by weight of alkali-soluble inorganic fine particles such as colloidal silica and said core containing 0.3 to 15% by weight of alkali-insoluble inorganic fine particles such as titanium oxide.

BRIEF DESCRIPTION OF THE DRAWINGS

A more complete appreciation of the invention and many of the attendant advantages thereof will be readily obtained as the same become better understood by reference to the following detailed description when considered in connection with the accompanying drawings, wherein.

DETAILED DESCRIPTION OF THE PREFERRED EMBODIMENTS

Figure 1:
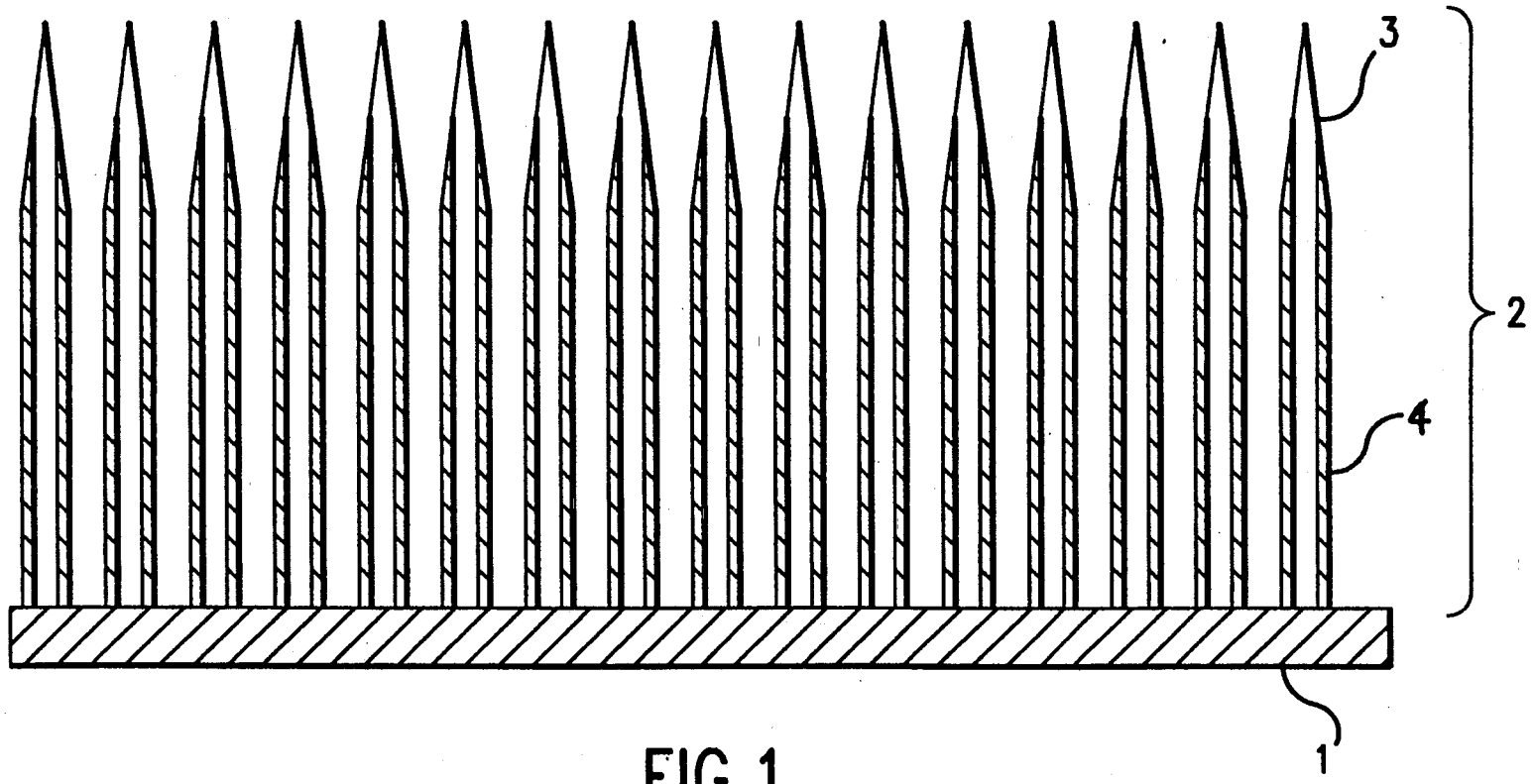
FIG. 1 is a schematic side view of the napped fabric according to the present invention, in which 2 designates a raised tapered fiber of napped fabric 1, the fiber having a tapered end 3 and a sheath part 4.
Figure 2:
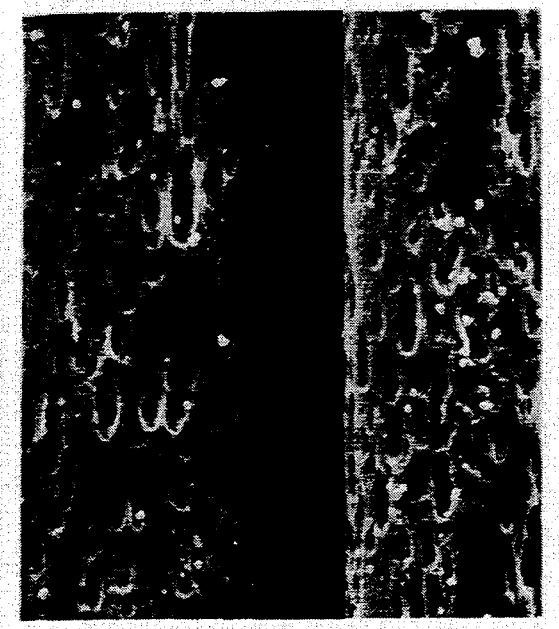
FIG. 2 is a photograph showing the surface of the exposed-core part at the tapered end 3 of one of tapered fibers constituting the napped fabric according to the present invention.
Figure 3:
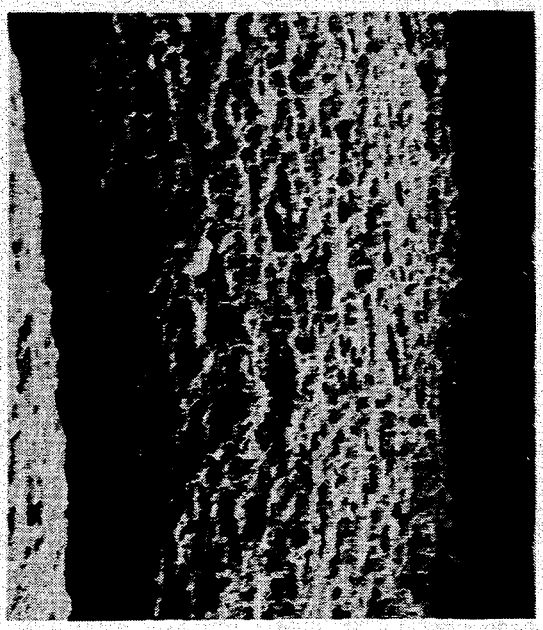
FIG. 3 is a photograph showing the side surface of the sheath part 4 of one of tapered fibers constituting the napped fabric according to the present invention.

The sheath-core composite polyester fiber (hereinafter referred to as "composite fiber") of the present invention is a composite fiber having single- or multi-core sheath-core cross-section. It is desirable that the fiber comprise for its core and sheath two different polyester components being melt composite spinnable and compatible with each other. It is also desirable that the fiber be a single-core composite fiber, which may either be concentric or eccentric. The cross-sectional shapes of the composite fiber and its core, which may be the same or different, may either be circular or irregular. The ratio by weight between the core and the sheath of the composite fiber is preferably in a range of 20/80 to 70/30, more preferably in a range of 30/70 to 60/40.

Examples of the polyester constituting the core or sheath of the composite fiber are polyethylene terephthalate (PET), polybutylene terephthalate (PBT) and polynaphthalene terephthalate (PEN). The polyester may be copolymerized with a small amount of a copolymerizable component within a limit not to impair the crystallinity of the polyester, such as diethylene glycol, neopentyl glycol, cyclohexane dimethanol, cyclohexanedicarboxylic acid, isophthalic acid, sulfoisophthalic acid or its sodium salt or polyalkylene glycol. The polyester may incorporate additives such as a luster improving agent, a flame retardant, a dyeability improving agent and an ultraviolet absorber.

There is no particular limitation to the degree of polymerization of the polyester used and it is preferably in the range used for ordinary polyester fiber, e.g. an intrinsic viscosity of about 0.6 to 0.8 dl/g.

In order to make the end of the composite fiber be tapered by alkali etching treatment, it is desirable that the polyester used for the sheath has a smaller alkali dissolution rate than that of the polyester used for the core. However, it sometimes happens that, depending on the types and amounts of the inorganic powders added, the optimum dissolution rate relationship reverses. In any case, the combination of polyesters should be properly selected such that the end of the resulting composite fiber is tapered by alkali etching. If, however, the difference between the alkali dissolution rates of the sheath polyester and the core polyester is too large, alkali etching of the resulting fiber sometimes causes selective decomposition, so that the treated fiber becomes too thin, whereby the finished napped fabric has weak KOSHI, the fiber being neatly tapered though.

The alkali dissolution rate herein is determined as follows. A yarn sample having the same fineness and number of filaments as the composite fiber is prepared from the polyester constituting the sheath or the core (if the sheath or core contains additives, the polyester sample for determination of the weight reduction percentage should also contain them in the same amounts). The yarn sample is treated with a 40 g/l aqueous sodium hydroxide solution at 96° C. or 40 minutes. The weight reduction percentage is obtained and employed as the alkali dissolution rate of the polyester constituting the sheath or the core.

The key feature of the present invention lies in the presence of recesses having a size range on the surface (surface of the sheath) other than the exposed core part of the composite fiber in a specific number per unit area and another group of recesses having a size range different from the above on the surface of the exposed core part of the tapered end in a specific number per unit area.

That is, there are formed on the surface (sheath surface) other than the exposed core part of the composite fiber recesses having a diameter of 0.2 to 0.7 $\mu m$ in a number per unit area of 20 to 1,000 pieces/100 $\mu m^2$ and on the surface of the exposed core part of the tapered end those having a diameter of 0.5 to 5 $\mu m$ in a number per unit area of 0.1 to 20 pieces/100 $\mu m^2$.

At first, the recesses formed on the surface (sheath surface) other than the exposed core part of the composite fiber are explained.

The diameter of a recess herein means the planar distance between the bottom point of a recess and that of another recess adjacent to the recess and present on the same circumference perpendicular to the fiber axis. This distance and the number of recesses per unit area can be measured with a scanning electron microscope.

While recesses having a diameter in the above range are formed on the surface (sheath surface) other than the tapered, exposed core part of the fiber, it is not necessary that they be formed on the whole surface other than the exposed core part. The object of the present invention can be achieved by such recesses being present at least on the surface of the tapered part other than the exposed core. It is, however, desirable for obtaining still deeper color and milder luster that the recesses be present on the entire surface other than the exposed core part of the fiber.

If there are present recesses having a diameter as defined above of less than 0.2 μm or the number of the recesses having a diameter of 0.2 to 0.7 μm is less than 20 pieces/100 $\mu m^2$, the mirror reflectivity of the fiber surface will decrease only to a small extent, thereby producing little effect of improving shining or clamminess of luster. If the diameter exceeds 0.7 μm, there will be created diffusion of light so that the mirror reflectivity of the fiber surface does increase. Further if the number of the recesses having a diameter of 0.2 to 0.7 μm exceeds 1,000 pieces/100 $\mu m^2$, the roughened structure of the fiber surface will become too minute and be readily destroyed caused by wear or the like so that the surface has mirror-like luster and shows white appearance.

To decrease the mirror reflectivity for light of the fiber surface (sheath surface) and promote absorption of light into the fiber, it is desirable that there be present recesses having a diameter in a range of 0.4 to 0.6 μm in a number per unit area of in a range of 50 to 500 pieces/100 $\mu m^2$.

Next, the recesses formed on the exposed core part of the tapered end of the composite fiber is explained. The definition of the diameter of the recesses formed on the exposed core part is the same as that for the above recesses on the fiber surface (sheath surface) and the diameter and number of the recesses are measurable with a scanning electron microscope.

If there are present recesses having a diameter as defined above of less than 0.5 μm or the number of the recesses having a diameter of 0.5 to 5 μm is less than 0.1 pieces/100 $\mu m^2$, napped fabrics utilizing such fiber will tend to produce dark fading. If the diameter exceeds 5 μm, the resulting napped fabrics will have poor hand. Likewise, if the number of the recesses having a diameter of 0.5 to 5 μm exceeds 20 pieces/100 $\mu m^2$, the napped fabrics will also have poor hand.

To decrease absorption of light of the exposed core part and through the fiber cross-section, it is desirable that there be present recesses having a diameter in a range of 0.7 to 2 μm in a number per unit area of in a range of 0.1 to 10 pieces/100 $\mu m^2$.

According to the present invention, use of tapered fibers having a group of recesses on the exposed core part of the tapered ends and another group of recesses having a different size range from that of the above first group recesses, for the nap of a napped fabric can render the fabric free from whitened seams, as well as from dark fading, white appearance and the like. The term "napped fabric" herein means fabrics with a soft fuzzy fibrous surface comprising a multiplicity of raised fibers and includes woven and knit fabrics of cut-pile and fabrics of moquette, double raschel, velour and velvet, thus being not limited to those obtained by brushing against a rough surface. With the fabric of the present invention, light incident on the surface other than the exposed core part of the nap fibers is reflected by minute recesses formed thereon and interfered with the reflected light. Besides, successively repeated reflection and absorption occurring around the peripheries of the recesses decreases the amount of reflected light. As a result, the mirror reflectivity of the fiber surface (sheath surface) decreases. On the other hand, since the recesses formed on the exposed core part of the fiber ends have larger diameter and are in smaller number compared with the recesses formed on the fiber surface (sheath surface), light incident on the exposed core part is diffused by the recesses there, whereby the light absorptivity of the exposed core part becomes small. This fact, together with the exposed core part being tapered to the tips, renders the side surface of the raised fibers undistinguishable from their cross-section and, thus, the problems of black fading, white appearance, as well as whitened seams as occurring upon extreme falling down of raised fibers, inherent to conventional napped fabrics with raised fibers of polyester fibers have been solved.

It is desirable that the tapered part of raised fibers have a length from the tip of at least 20% of the whole raised length from the tip and, to prevent their falling down, preferably at least 50% of the whole raised length. The term "tapered part" herein means part of a raised fiber the diameter of which is substantially smaller than, more concretely not more than 90% of, that of the root part of the fiber.

It is desirable that the napped fabric of the present invention have raised fibers with a raised length of not more than 10 mm, in particular not more than 5 mm. As the length increases beyond 10 mm, the effect produced by the present invention gradually decreases. The number per unit area of the raised fiber is preferably $7\times10^3$ to $8\times10^6$ pieces/$cm^2$, more preferably $10^4$ to $2\times10^5$ pieces/$cm^2$. Too high a number per unit area renders it difficult to achieve uniform tapering by alkali etching to be described later herein. On the other hand, too low a number per unit area hardly produces suitably tapered shape.

If the root part, which is not tapered, of tapered fibers constituting the nap becomes too thin, the fibers will readily fall down and the resulting fabric will have weak KOSHI. The fineness of the root part is therefore preferably in a range of 2 to 6 deniers. With conventional polyester fiber napped fabrics, a fiber fineness exceeding 3 deniers generally causes itchy, unpleasant feeling. According to the present invention, the problem of itchy feeling is also solved, whereby thicker fibers can be used for nap, which in turn prevents falling-down phenomenon.

It is not necessary, in the napped fabric of the present invention, that all of the fibers constituting the nap be the above-described tapered fibers, and it is sufficient that part, for example at least 30%, preferably at least 50% of the constituting fibers be the tapered fibers.

An example of available processes for obtaining the tapered fiber, having on its end part recesses with specific shape, of the present invention is described below.

Sheath-core composite polyester fibers with the core containing 0.3 to 15% by weight of alkali-insoluble inorganic fine particles and the sheath containing 0.5 to 5% by weight of alkali-soluble inorganic fine particles is treated with alkali. Then, at least one end of each of the raised fibers is tapered and two groups of recesses having specific, different sizes are formed each in a specific number per unit area on the exposed core part of the tapered part and on the fiber surface other than the exposed core part.

Examples of the alkali-insoluble inorganic fine particles to be contained in the core are titanium oxide, zirconium oxide, zinc oxide, lithopone and barium sulfate, among which titanium oxide is preferred because of good, uniform dispersibility in polyester and higher reflectivity than polyester. With the content being less than 0.3% by weight, the number of recesses formed on the exposed core part of the tapered fiber will become small so that the desired roughened surface structure cannot be obtained. On the other hand, if the content exceeds 15% by weight, there will occur, during spinning, frequent clogging of spinneret holes and filament breakage. There are no specific limitation to the average diameter of the alkali-insoluble inorganic fine particles used, but it is preferably not more than 1.0 μm, more preferably not more than 0.5 μm in order to form on the exposed core part recesses having a diameter of 0.5 to 5 μm in a number per unit area of 0.1 to 20 pieces/100 $\mu m^2$.

Examples of the alkali-soluble inorganic fine particles to be contained in the sheath are silica, calcium carbonate and kaolin, among which colloidal silica is preferred because of its reflectivity being smaller than polyester. If such fine particles are contained in an amount less than 0.5% by weight, the number of recesses formed on the surface other than the exposed core part of the resulting tapered fiber will become small so that the effect of the present invention becomes difficult to produce. On the other hand, if the content exceeds 5% by weight, there will tend to generate aggregates of particles, which impair stability of fiber formation operation, the number of recesses increasing though. There is no particular limitation to the average particle diameter of the alkali-soluble inorganic fine particles, but it is preferably not more than 0.2 μm, more preferably not more than 0.1 μm, in order to form on the surface other than the exposed core part of the tapered fiber recesses having a diameter of 0.2 to 0.7 μm in a number per unit area of 20 to 1,000 pieces/100 $\mu m^2$. The diameter of an inorganic particle is measured by the known optical method or laser scattering method.

The alkali treatment used in the present invention is conducted under the usual alkali etching conditions, preferably with an aqueous hydrolyzing agent solution containing a thickener, which assures uniform tapering. Alkaline compounds such as sodium hydroxide and potassium hydroxide are usable hydrolyzing agents. As occasions demand, hydrolysis accelerating agents such as laurylbenzylammonium chloride and cetyltrimethylammonium chloride may be used in combination.

Examples of the thickener to be added to the hydrolyzing agent used are natural polymeric thickeners such as starch, natural gum and sodium alginate and synthetic polymeric thickeners such as polyvinyl alcohol, sodium polyacrylate and styrene-maleic acid copolymer. Other thickeners are also usable without limitation insofar as they do not hydrolyze the composite fiber and can be homogeneously dispersed in the hydrolyzing agent solution used.

It is desirable that the hydrolyzing agent solution containing a thickener have a viscosity in a range of 100 to 2,000 cps under room temperature condition. This range suppresses too rapid hydrolysis and unfavorable capillarity effect of the hydrolyzing solution and realizes the desired, good tapered shape.

Alkali treatment of napped fabrics with raised fibers comprising the tapered fibers of the present invention is also conducted in the same manner as for the fiber itself.

At first, napped fabrics with raised fibers comprising the sheath-core composite polyester fibers are formed from any of knit pile, woven pile, moquette, double raschel, velour and velvet, or by tufting, electrical flocking or like processes. Then, a hydrolyzing agent solution containing a thickener is applied to the end part of the raised fibers of the obtained napped fabric by padding, gravure coating, kiss-coating, knife-coating, printing, rotary screen process. It is preferred to employ, among the above processes, padding which comprises for example passing a napped fabric, while keeping its napped face down, on a hydrolyzing solution in such a manner that only the napped part of the fabric is immersed in the solution and then squeezing the fabric through a mangle to remove excess hydrolyzing agent solution. This process enables the raised fibers to form recesses with specific shape down to the root part of the fibers. In this case the mangle squeezing ratio is preferably 30 to 70% by weight of remaining hydrolyzing agent solution based on the weight of the napped fabric, more preferably 40 to 60% by weight on the same bases. Upon padding this way, the hydrolyzing agent solution preferably has a viscosity of 150 to 1,000 cps and an alkali concentration of 1 to 30% by weight where sodium hydroxide is used.

The napped fabric with the raised fibers to which a hydrolyzing agent solution has been applied by any one of the above processes is then heated by dry heating such as with hot air or infrared heater or wet heating such as steaming. Where dry heating is employed, there may often occur too early drying up of the hydrolyzing agent solution, thereby rendering it difficult to produce sufficient etching effect. To avoid this, it is desirable to select an appropriate heating system, temperature, time and the like depending on the composition and type of the fiber constituting the nap, type of the hydrolyzing agent solution and other conditions.

It is generally preferred to wet heat at 80° to 180° C. for 5 to 120 minutes.

According to the present invention, application of a viscous solution containing a hydrolyzing agent to the ends of the raised fibers of a napped fabric and comprising sheath-core composite polyester fibers, followed by heat treatment, permits the ends of the fibers to be tapered and, at the same time, forms two types of recesses having specific shapes in specific densities on the exposed core part of the tapered ends and on the fiber surface other than the exposed core part, respectively. The resulting fabric has a soft hand and further, when dyed, has the following excellent features. Light incident on the fiber surface (sheath surface) other than the exposed core part is reflected outwardly only to a small extent due to minute recesses formed thereon, whereby the mirror reflectivity of the surface (sheath surface) becomes smaller. On the other hand, light incident on the exposed core part is diffused due to the presence of recesses formed thereon, whereby the light absorptivity of the exposed core part becomes small. The above phenomena, together with the fact that the exposed core part is tapered, render the side surface of the fibers constituting the nap undistinguishable from their cross-section. As a result, there can be solved the problems of dark fading and white appearance resulting from luster difference and color difference, in particular whitened seams due to extreme falling down of raised fibers, which have been inherent to conventional napped fabric with raised fibers comprising conventional polyester fibers.

Other features of the invention will become apparent in the course of the following description of exemplary embodiments which are given for illustration of the invention and are not intended to be limiting thereof. In the Examples and Comparative Examples that follow, the intrinsic viscosity of polyester is determined by viscosity measurement conducted at 30° C. on a sample dissolved in a 1:1 by weight mixed solvent of phenol/-tetrachloroethane. To measure the diameter and number of recesses, electron microphotographs with a magnification of at least 5,000 are taken on 3 fiber samples and 2 parts of each photograph are subjected to measurement. For the number per unit area, an average of the results of $3\times2=n$ measurements is taken.

with super-heated steam in an H.T. steamer at 150° C. for 5 to 15 minutes.

The thus treated knits were dyed with two types, blue and beige, of disperse dyed in a Obermeyer dyeing machine. The ends of the dyed raised fibers were observed under an optical microscope to show that 25 to 30% of the raised length was tapered to the tip. The exposed core part at the tapered ends and the surface other than the exposed core part were observed in a scanning electron microscope, to show recesses with diameters and densities as shown in Table 1.

TABLE 1

| Sample No. | 1 | 2 | 3 | 4 | 5 | 6 |
|---|---|---|---|---|---|---|
| Fine particles | | | | | | |
| Core | | | | | | |
| Ave. dia. (μm) | 0.2 | 0.2 | 0.2 | 0.2 | 0.2 | 0.05 |
| Content (wt %) | 0.1 | 1.5 | 3.0 | 10.0 | 0.3 | 0.5 |
| Sheath | | | | | | |
| Ave. dia. (μm) | 0.03 | 0.03 | 0.03 | 0.03 | 0.03 | 0.03 |
| Content (wt %) | 1.0 | 1.5 | 3.0 | 3.0 | 3.0 | 3.0 |
| Tapering tapered part/ raised length | 25% | 25% | 30% | 30% | 30% | 30% |
| Recesses | | | | | | |
| Core | | | | | | |
| diameter (μm) | 0.9–1.9 | 0.75–0.9 | 0.8–1.1 | 0.5–0.7 | 0.75–0.95 | 0.65–0.9 |
| number (pcs/ 100 $\mu m^2$) | 0.05 | 2.3 | 6.7 | 10.0 | 1.6 | 20 |
| Sheath | | | | | | |
| diameter (μm) | 0.3–0.7 | 0.3–0.65 | 0.3–0.55 | 0.2–0.5 | 0.25–0.55 | 0.2–0.5 |
| number (pcs/ 100 $\mu m^2$) | 21 | 79 | 135 | 190 | 161 | 183 |
| Evaluation | | | | | | |
| Hand (1) | ○ | ◎ | ◎ | ○ | ○ | ○ |
| Appearance (2) | ○ | ◎ | ◎ | ○ | ○ | ○ |
| Dark fading (3) | X | ○ | ◎ | ◎ | ○ | Δ-○ |
| White appearance (4) | Δ | ○ | ◎ | ◎ | ○ | ○ |
| Whitened seams (5) | X | ○ | ◎ | ◎ | ○ | ○ |

EXAMPLE 1

A series of sheath-core composite filament yarns with the core comprising a polyethylene terephthalate having an intrinsic viscosity of 0.65 dl/g or polybutylene terephthalate having an intrinsic viscosity of 0.80 dl/g (Sample No. 5) and containing titanium oxide particles having an average particle diameter of 0.2 μm or 0.05 μm in amounts as shown in Table 1 and the sheath comprising another polyethylene terephthalate having an intrinsic viscosity of 0.68 dl/g and containing coloidal silica having an average particle diameter of 0.03 μm in amounts as shown in Table 1, the ratio by weight between the core and the sheath being 1:2 were spun and taken up at a speed of 1,000 m/min. The yarns were then drawn at 75° C. in a ratio of 3.2 and heat treated at 130° C. under tension, to yield drawn concentric sheath-core composite filament yarns of 200 denier/72 filaments.

Each of the yarns was knitted into a double raschel knit (pile density: 18,000 pieces/$cm^2$) with a ground yarn of conventional polyester yarn (75 denier/24 filaments). The knitted fabric was sheared into a cut pile fabric having a pile length of 3 mm and then dry preheatset at 180° C. through a pin tenter.

An aqueous sodium hydroxide solution containing 3% by weight of sodium alginate as a thickener (concentration: 28% by weight; viscosity measured with a type-B viscometer at 20° C., 65% RH: 12,000 cps) was applied through a rotary screen to the nap part of each of the fabrics and then the fabrics were wet heat treated In the above table, the results of evaluation are expressed according to the following ratings.

(1) Hand

◎: soft hand, smooth touch
○: smooth touch
Δ: a little itchy
X: itchy and coarse (2) Appearance ◎: moderate luster and calm appearance
○: mild luster
Δ: straw-colored
X: shining (3) Dark fading ◎: no dark fading at all
○: difficult to recognize dark fading
Δ: looks dark when viewed under direct sunlight
X: dark fading appears (4) White appearance ◎: no white appearance at all
○: difficult to recognize white appearance even when folded
Δ: white appearance shows when folded and viewed from a low angle
X: overall white appearance (5) Whitened seams ◎: no whitened seam at all ○: difficult to recognize whitened seam Δ: whitened seam does not show when dyed in blue but shows when dyed beige X: whitened seam shows both with blue and beige.

The pile fabrics of sample Nos. 2 through 6, which had raised fibers tapered smoothly to their tips, had good soft touch and, nevertheless, had anti-drape stiffness (HARI) and KOSHI and developed good deep color. These fabrics showed little dark fading, white appearance or whitened seams. The pile fabric of sample No. 1, having too small number of recesses formed on the exposed core part, showed whitened seams both for blue and beige.

COMPARATIVE EXAMPLES 1 THROUGH 8

Example 1 was repeated several times except that the inorganic fine particles contained in the core and those in the sheath were changed as shown in Tables 2 and 3, to prepare a series of double raschel knitted fabrics. The nap part of each of the knitted fabrics were treated with an aqueous sodium hydroxide solution containing a thickener, under different treating conditions. The treated fabric were dyed in blue and beige, and evaluated. The results are shown in Tables 2 and 3.

TABLE 2

| | Comp. Ex. 1 | Comp. Ex. 2 | Comp. Ex. 3 | Comp. Ex. 4 |
|---|---|---|---|---|
| Fine particles | | | | |
| Core | | | | |
| Type | None | None | Titanium oxide | Titanium oxide |
| Ave. dia. (μm) | — | — | 0.2 | 0.2 |
| Content (wt %) | — | — | 0.5 | 3.0 |
| Sheath | | | | |
| Type | Colloidal silica | Titanium oxide | None | None |
| Ave. dia. (μm) | 0.03 | 0.2 | — | — |
| Content (wt %) | 3.0 | 1.0 | — | — |
| Tapering Tapered part/ raised length | 25% | 25% | 10% | 20% |
| Recesses | | | | |
| Core | | | | |
| Diameter (μm) | 0.001–0.01 | 0.005–0.02 | 0.8–1.0 | 0.8–1.0 |
| Number (pcs/ 100 $\mu m^2$) | 0.01> | 0.01> | 5.1 | 6.0 |
| Sheath | | | | |
| Diameter (μm) | 0.2–0.5 | 0.8–1.0 | 0.01–0.03 | 0.001–0.01 |
| Number (pcs/ 100 $\mu m^2$) | 172 | 5 | 0.01> | 0.01> |
| Evaluation | | | | |
| Hand | ○ | | Δ | Δ |
| Appearance | X | Δ | Δ | Δ |
| Dark fading | Δ | Δ | X | Δ |
| White appearance | Δ | Δ | X | X |
| Whitened seams | Δ | X | X | X |

The evaluation ratings were same as before.

TABLE 3

| | Comp. Ex. 5 | Comp. Ex. 6 | Comp. Ex. 7 | Comp. Ex. 8 |
|---|---|---|---|---|
| Fine particles | | | | |
| Core | | | | |
| Type | Titanium oxide | Titanium oxide | Colloidal silica | Colloidal silica |
| Ave. dia. (μm) | 0.2 | 0.05 | 0.03 | 0.03 |
| Content (wt %) | 3.0 | 0.1 | 3.0 | 3.0 |
| Sheath | | | | |
| Type | Titanium oxide | Colloidal silica | Colloidal silica | Titanium oxide |

TABLE 3-continued

| | Comp. Ex. 5 | Comp. Ex. 6 | Comp. Ex. 7 | Comp. Ex. 8 |
|---|---|---|---|---|
| Ave. dia. (μm) | 0.2 | 0.03 | 0.03 | 0.2 |
| Content (wt %) | 0.5 | 3.0 | 3.0 | 0.3 |
| Tapering Tapered part/ raised length | 20% | 25% | 15% | 10% |
| Recesses | | | | |
| Core | | | | |
| Diameter (μm) | 0.8–1.0 | 0.65–0.8 | 0.2–0.5 | 0.2–0.45 |
| Number (pcs/ 100 $\mu m^2$) | 6.5 | 0.05 | 148 | 152 |
| Sheath | | | | |
| Diameter (μm) | 0.75–0.9 | 0.3–0.7 | 0.2–0.6 | 0.75–0.95 |
| Number (pcs/ 100 $\mu m^2$) | 4.6 | 127 | 151 | 4.0 |
| Evaluation | | | | |
| Hand | Δ | ○ | ○ | Δ |
| Appearance | X | ○ | ○ | ○ |
| Dark fading | Δ | Δ | Δ | Δ |
| White appearance | Δ | Δ | Δ | Δ |
| Whitened seams | Δ | Δ | X | Δ |

The evaluation ratings are same as before.

The pile fabric of Comparative Example 1 had a small amount of very fine recesses on the exposed core part of the raised fibers so that it was difficult to soil. The fabric however showed dark fading, white appearance and whitened seams, particularly when dyed in beige.

The pile fabric of Comparative Example 2 had a small amount of relatively large recesses on the surface of the sheath part of the raised fibers so that it developed, when dyed, no deep color and had poor appearance. The fabric also showed marked whitened seams both for blue and beige.

The pile fabrics of Comparative Examples 3 and 4 had almost no recesses on the surface of the sheath part of raised fibers so that it had poor appearance and showed marked white appearance and whitened seams.

The pile fabrics of Comparative Example 5 had relatively large recesses on the surface of the sheath part so that it had a large mirror reflectivity and very poor appearance.

The pile fabrics of Comparative Examples 6 and 7 had recesses on the exposed core part. The diameter and number of recesses, however, were both out of the range specified in the present invention. Such recesses cannot eliminate dark fading, white appearance or whitened seams.

The pile fabric of Comparative Example 8 had two types of recesses on the exposed core part and sheath part respectively, but their diameters and densities were just reverse of those of the fabrics obtained in Example 1. The fabric had poor hand and produced no effect of improving dark fading, white appearance or whitened seams.

Obviously, numerous modifications and variations of the present invention are possible in light of the above teachings. It is therefore to be understood that within the scope of the appended claims, the invention may be practiced otherwise than as specifically described herein.

What is claimed is:

1. A napped fabric with raised fibers comprising tapered fibers which are tapered to form tips, said fabric being obtained by subjecting to alkali etching treatment a precursor napped fabric with precursor raised fibers having a raised length of not more than 10 mm and comprising sheath-core composite polyester fibers consisting of a core containing 0.3 to 15% by weight of alkali insoluble inorganic fine particles and a sheath containing 0.5 to 5% by weight of alkali soluble fine particles, to permit said polyester fibers to be tapered to their tips so that the cores are exposed outwardly along the tips, said exposed core part having recesses on the surface thereof, there being 0.1 to 20 recesses/100 $\mu m^2$ of surface area, the recesses having a diameter of 0.5 to 5 $\mu m$ and the sheath having recesses on the surface thereof, there being 20 to 1,000 recesses/100 $\mu m^2$ of surface area, the recesses having a diameter of 0.2 to 0.7 $\mu m$.

2. The napped fabric according to claim 1, wherein said raised fibers are tapered to the tips thereof in a length of at least 20% of the whole raised length thereof.

3. The napped fabric according to claim 1, wherein said raised fibers are tapered to the tips thereof in a length of 20 to 50% of the whole raised length thereof.

* * * * *